United States Patent [19]

Paris

[11] 4,415,099

[45] Nov. 15, 1983

[54] APPARATUS FOR MAINTAINING FREE MOVEMENT OF A MIXING OBJECT IN A PRESSURIZED CONTAINER

[75] Inventor: Rafael R. Paris, Largo, Fla.

[73] Assignee: Grow Group, Inc., New York, N.Y.

[21] Appl. No.: 272,476

[22] Filed: Jun. 11, 1981

[51] Int. Cl.[3] ..... B65D 35/22

[52] U.S. Cl. ..... 222/94; 222/386.5; 222/402.1; 222/464

[58] Field of Search ..... 222/402.1, 402.24, 190, 222/386.5, 94, 95, 130, 82, 92, 93, 189, 464; 366/130; 239/142, 323, 328, 337, 573

[56] References Cited

U.S. PATENT DOCUMENTS

| | | | |
|---|---|---|---|
| 3,184,118 | 5/1965 | Webster | 222/464 |
| 3,202,319 | 8/1965 | Howard | 222/41 |
| 3,235,137 | 2/1966 | Bonduris | 222/263 |
| 3,240,391 | 3/1966 | Garton | 222/80 |
| 3,381,863 | 5/1968 | Towns | 222/389 |
| 3,490,656 | 1/1970 | Taschner | 222/394 |
| 3,620,420 | 11/1971 | Normos | 222/386.5 |
| 3,705,669 | 12/1972 | Cox et al. | 222/394 |
| 3,718,236 | 2/1973 | Reyner et al. | 222/386.5 |
| 3,878,975 | 4/1975 | Schultz | 222/389 |
| 4,062,475 | 12/1977 | Harris et al. | 222/95 |

*Primary Examiner*—Joseph J. Rolla
*Assistant Examiner*—Thomas C. Fitzgerald
*Attorney, Agent, or Firm*—Kenyon & Kenyon

[57] ABSTRACT

Disclosed is apparatus for maintaining free movement of an object such as a steel or glass ball in a pressurized container which includes a flexible chamber for isolating a product and a propellant for the product. The object is freely movably disposed in the product and is adapted to mix the product upon shaking the container. The apparatus according to the invention comprises an elongated base having a plurality of spaced-apart protrusions projecting outwardly from the base. The protrusions extend from the base spaced from an end thereof. The apparatus is adapted to be secured in the container with the end of the base disposed at the bottom of the container. The apparatus maintains a path of free motion for the mixing object and in the case of an expandable chamber which contains the propellant, allows maximum expansion of the chamber without preventing or impeding motion of the mixing object.

32 Claims, 5 Drawing Figures

APPARATUS FOR MAINTAINING FREE MOVEMENT OF A MIXING OBJECT IN A PRESSURIZED CONTAINER

BACKGROUND OF THE INVENTION

The present invention relates generally to pressurized or aerosol type containers having a flexible chamber and a freely movable object disposed in the container for mixing the product in the container. More particularly, the present invention relates to apparatus for maintaining free movement of the mixing object in such containers, and to containers including such apparatus.

In pressurized or aerosol containers of the type which include a flexible chamber and a freely movable object, e.g. a glass or steel ball, in the container for mixing the product upon shaking the container, it is possible for the movable object to be rendered immobile or its motion impeded, for example, by engagement with the flexible chamber or between the flexible chamber and the interior, particularly the bottom, of the container. If the object should become so engaged and rendered immobile, or its free movement impeded, then mixing of the product prior to dispensing may be impaired.

Such impaired mixing can occur, for example, in a pressurized container which includes a flexible, expandable propelling chamber of the type disclosed in U.S. Pat. No. 3,718,236 issued on Feb. 27, 1973 entitled *PRESSURIZED CONTAINER WITH NON-RIGID FOLLOWER*. In a container of the type disclosed in the '236 patent, reactions in a pouch or bag-like enclosure generate gas which expands the pouch and exerts pressure on the product to dispense it from the container through an outlet valve upon actuation thereof. A glass or steel ball disposed in the product for mixing the product upon shaking the container could become engaged by the expanding pouch, particularly between the pouch and the container bottom when the pouch has expanded and occupies almost all of the volume in the container.

OBJECTS AND SUMMARY OF THE INVENTION

It is an object of the present invention to improve mixing of a product in a pressurized or aerosol type container which includes a flexible chamber and a freely movable object disposed in the product for mixing the product upon shaking the container.

It is another object of the present invention to improve mixing of a product in a pressurized container which includes a flexible, expandable chamber and a freely movable object such as a glass or steel ball disposed in the product for mixing the product upon shaking the container.

It is another object of the present invention to maintain the mixing object of the aforementioned containers freely movable.

These and other objects are achieved in accordance with the invention by providing apparatus disposed or adapted to be disposed in a pressurized or aerosol container including a flexible chamber and a freely movable object disposed in the product for mixing the product upon shaking the container, the apparatus providing an unimpeded volume for the mixing object to move in, and by providing a container which includes such apparatus.

More particularly, apparatus in accordance with the invention provides paths of free movement of the movable object in a pressurized container which includes a flexible chamber for isolating a product and a means for propelling the product. The object is freely movably disposed in the product and is adapted to mix the product upon shaking the container. The apparatus according to the invention comprises an elongated base having a plurality of spaced-apart protrusions projecting outwardly from the base. The protrusions extend from the base spaced from an end thereof. The apparatus is adapted to be secured in the container with said end of the base disposed at the bottom of the container.

The protrusions extend downwardly from the base towards said base end when the device is disposed in the container. The protrusions can be of a petal-like shape and can be sized and made of a material so as to be bendable relative to the base and can include a section of reduced width adjacent to the base which facilitates bending of the protrusions downwardly. The edges of the protrusions are preferably dulled to prevent rupture of the flexible chamber by the protrusions. The base is preferably generally cylindrical and is preferably hollow.

A plurality of openings can be provided in a hollow base to communicate the interior of the base with the exterior thereof.

Apparatus according to the invention prevents the expandable chamber from expanding non-uniformly to the bottom of the container. Thereby, engagement of the freely movable object, for example, between an otherwise non-uniformly expanding chamber and the container bottom is prevented. The invention thereby insures that the object remains freely movable even when the flexible chamber is almost completely expanded. Thus, product remaining in the container when the chamber is almost fully expanded can be properly mixed prior to dispensing it.

Further in accordance with the invention, a pressurized or aerosol container is provided with such apparatus disposed therein. The apparatus can include protrusions as described above and can be secured to the container bottom by adhering ends of the protrusions to the container at or adjacent to the container bottom.

In a disclosed embodiment, the flexible chamber of the container is expandable and contains a propellant for the product. The expandable chamber can be of the type disclosed in U.S. Pat. No. 3,718,236 in which reactions in the chamber generate a gas which fills and expands the chamber and exerts pressure on the product.

These and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Referring more particularly now to the drawings, a petal-like guard device and a pressurized container including the petal-like guard device, both in accordance with the invention, are illustrated.

Figure 1:
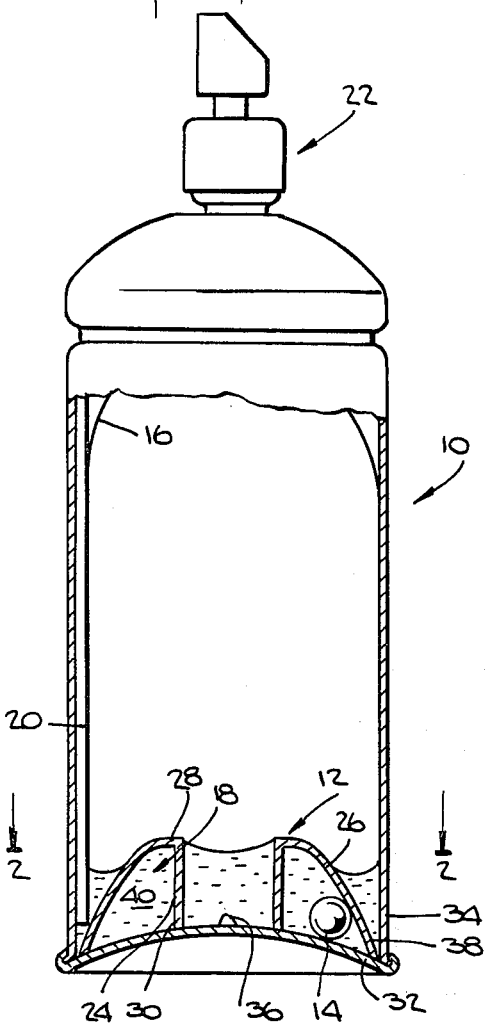
FIG. 1 is an elevation view, partly in section of a pressurized container including a flexible chamber, a mixing ball and a guard apparatus according to the invention which is disposed at the bottom of the container.

A pressurized container 10 is illustrated in FIG. 1 with the petal-like guard device 12 disposed therein. The pressurized container 10 can be of the type disclosed in U.S. Pat. No. 3,718,236, the disclosure of which is incorporated herein by reference, and which includes therein a freely movable ball 14, of for example, glass or steel and an expandable, flexible chamber 16. However, the invention is not so limited and is applicable to other types of pressurized containers which include a flexible chamber therein and a freely movable object used for mixing the product upon shaking the container.

The chamber 16 in FIG. 1 is made of flexible material such as plastic and is expandable to exert pressure on the product 18 to dispense it via a dip tube 20 through valve 22 upon activation thereof. The chamber 16 is shown in FIG. 1 in an almost fully expanded configuration.

Disposed at the bottom of container 10 is the petal-like device 12 which comprises a base 24 and a plurality of petal-like protrusions 26. The base 24 can be of hollow cylindrical configuration. The protrusions 26 extend equally-spaced from the top 28 of the base towards the bottom 30 of the base spaced outwardly therefrom. The protrusions are secured, for example by an organic or other adhesive or by welding, to the bottom of the container about the circumference thereof adjacent the bottom wall 32 and the vertical cylindrical wall 34.

The hollow cylindrical base includes a plurality of tunnel-like or arched apertures 36 which communicate the interior of the base with the exterior thereof. The apertures aid in the flow of product at the bottom of the container and thus enhance mixing. The container can thereby be provided with product in the hollow base which can freely move from the exterior to the interior of the base through the apertures.

Figure 2:
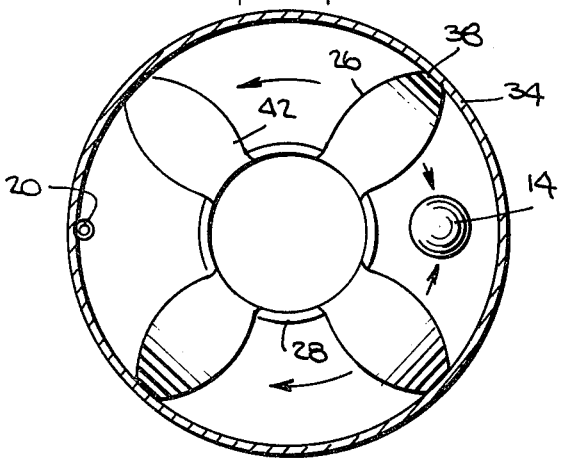
FIG. 2 is a section view taken along lines 2—2 of FIG. 1.

The protrusions 26 extend outwardly from the top 28 of the base towards the base bottom 30 with the protrusion ends 38 being spaced outwardly from the bottom 30 of the base to define a volume 40 bounded by the container bottom wall, the device base and protrusions. The volume 40 is sufficiently large to accommodate the ball 14 freely movable therein. The ball can follow a circular path at the bottom of the container as indicated in FIG. 2 by the arrows, which path will not be impeded by the expanding chamber.

When the flexible container has expanded into its initial contact with the device 12, further expansion of the chamber past the device 12 is substantially prevented, thereby insuring that the chamber expands uniformly when it reaches the bottom of the container.

Thus, the chamber is prevented from expanding into volume 40 thereby preventing engagement of the ball 14, for example between the chamber and the bottom of the container. Accordingly, the ball 14 may be freely moved through the product 18 remaining in the bottom of the container upon shaking the container.

Figure 5:
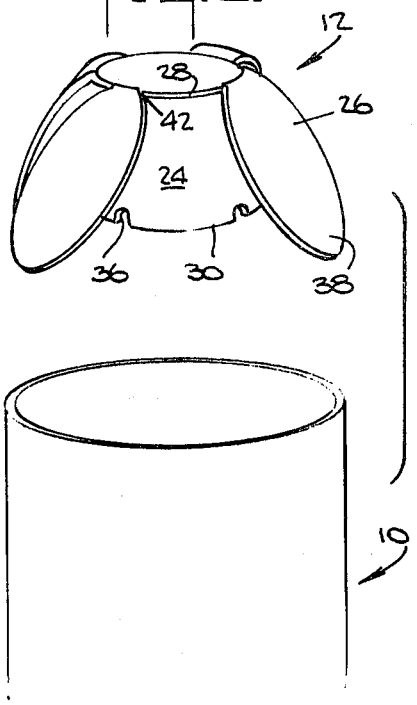
FIG. 5 is a perspective, exploded view of the guard apparatus depicted in FIG. 1 and a portion of the container depicted in FIG. 1.
Figure 4:
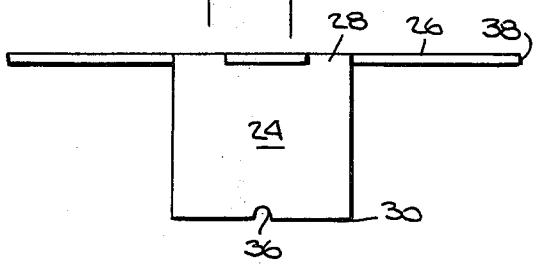
FIG. 4 is an elevation view of the guard apparatus depicted in FIG. 3.
Figure 3:
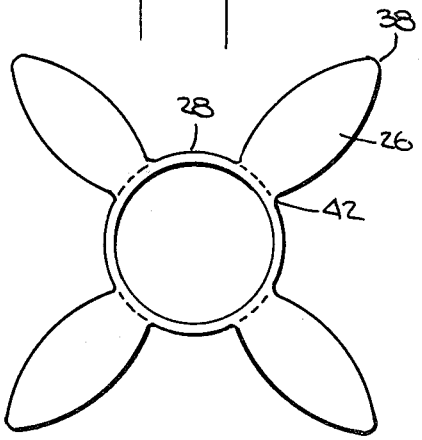
FIG. 3 is a plan view of the guard apparatus according to the invention prior to bending the protrusions and adhering the apparatus in a container.

The device 12 can be supplied in the form depicted in FIGS. 3 and 4, i.e., with the protrusions extending generally radially from the top 28 of the base 24. Thereafter, the protrusions can be bent into the configuration described above and depicted in FIGS. 1 and 5. To facilitate bending, the protrusions are suitably sized and made of a suitable material, and can include a narrowed portion 42 adjacent to the base 24. The edges of the protrusions are preferably dulled to prevent them from puncturing the flexible chamber.

The device 12 can be constructed of high impact plastic or metal such as aluminum which is capable of withstanding pressures of up to 160 pounds per square inch or more which can be exerted by the expanding chamber.

The apertures preferably include upper arched surfaces and preferably have the dimensions defined by the following equation: $\frac{1}{2}H=W=(\frac{1}{8}$ to $1/10)\times D$, where H is the height of the aperture and W is the width of the aperture, and D is the diameter of the cylindrical base.

The device can include four equally spaced protrusions 26 and three equally spaced apertures 36.

For a nine ounce container, the ball 14 can be of about 8.5 mm diameter, the diameter of the cylindrical base 24 can be about 19 mm, the height of the cylindrical base can be about 15 mm, and the length of the protrusions can be about 19 mm. For a device with those dimensions, the height of the arched apertures can be about 4 mm and their width about 2 mm.

The dimensions of device 12 can be increased or decreased from the dimensions given above in accordance with the increase or decrease, respectively, of the container size.

As described above, the expansion of the propelling chamber in a conventional container can be irregular and can impede motion of the ball or render the ball immobile. According to the invention, the guard device 12 maintains a path of free motion for the mixing ball, while allowing for maximum expansion of the flexible chamber. Accordingly, a maximum amount of properly mixed product can be dispensed from the container.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. Apparatus for maintaining unimpeded movement of an object in a pressurized container having a flexible chamber for isolating a fluent product and a propellant which aids in dispensing of the product, the object being freely movably disposed in the product which is located outside the flexible chamber and adapted to mix the product upon shaking the container, the apparatus being structured to define in cooperation with a portion of the container a volume in which the object is movable and for allowing passage of the fluent product and the object into and out of the volume while substantially preventing entry of the flexible chamber into the volume.

2. The apparatus of claim 1 which includes a plurality of spaced-apart elements defining at least in part said volume which allow passage of product and the object therebetween.

3. The apparatus of claim 2 wherein said elements have dulled edges.

4. The apparatus of claim 2 which includes a base portion from which the elements extend.

5. The apparatus of claim 4 wherein said elements are of petal-like shape.

6. The apparatus of claim 4 wherein the base portion is generally cylindrical.

7. The apparatus of claim 4 wherein said elements are sized and made of a material so as to be bendable relative to the base portion.

8. The apparatus of claim 7 wherein said elements include a narrowed portion adjacent the base portion to facilitate bending of the elements relative to the base portion.

9. The apparatus of claim 4 wherein said elements extend equally spaced from the base portion.

10. The apparatus of claim 9 wherein four elements extend from the base portion.

11. The apparatus of claim 4 wherein the base portion is elongated having an upper and a lower end, and the elements extend from the base portion spaced from the lower end thereof, the apparatus being adapted to be secured in the container with the lower end of the base portion disposed at the bottom of the container.

12. The apparatus of claim 11 wherein said elements extend downwardly as well as outwardly from the base portion towards said lower end when the apparatus is disposed in the chamber.

13. The apparatus of claim 4 wherein the base portion is hollow.

14. The apparatus of claim 13 wherein a plurality of apertures are provided in the base portion to communicate the interior of the base portion with the exterior thereof.

15. The apparatus of claim 14 wherein the apertures are equally spaced about the periphery of the base portion.

16. The apparatus of claim 15 wherein three apertures are provided in the base portion.

17. In a pressurized container including a flexible chamber for isolating a fluent product and a propellant which aids in dispensing the product, and an object freely movably disposed in the product which is located outside the flexible chamber and adapted to mix the product upon shaking the container, the improvement comprising apparatus structured to define in cooperation with a portion of the container a volume in which the object is movable and for allowing passage of the fluent product and the object into and out of the volume while substantially preventing entry of the flexible chamber into the volume.

18. The apparatus of claim 17 which includes a plurality of spaced-apart elements defining at least in part said volume which allow passage of product and the objected therebetween.

19. The apparatus of claim 18 wherein said elements have dulled edges.

20. The apparatus of claim 18 which includes a base portion from which the elements extend.

21. The apparatus of claim 20 wherein said elements are of petal-like shape.

22. The apparatus of claim 20 wherein the base portion is generally cylindrical.

23. The apparatus of claim 20 wherein the base portion is elongated having an upper and a lower end, and the elements extend from the base portion spaced from the lower end thereof, the apparatus being adapted to be secured in the container with the lower end of the base portion disposed at the bottom of the container.

24. The apparatus of claim 23 wherein the elements extend downwardly as well as outwardly from the base portion towards said lower end when the apparatus is disposed in the chamber.

25. The apparatus of claim 20 wherein said elements are sized and made of a material so as to be bendable relative to the base portion.

26. The apparatus of claim 25 wherein said elements include a narrowed portion adjacent the base portion to facilitate bending of the elements relative to the base portion.

27. The apparatus of claim 20 wherein said elements extend equally spaced from the base portion.

28. The apparatus of claim 27 wherein four elements extend from the base portion.

29. The apparatus of claim 20 wherein the base portion is hollow.

30. The apparatus of claim 29 wherein a plurality of apertures are provided in the base portion to communicate the interior of the base portion with the exterior thereof.

31. The apparatus of claim 30 wherein the apertures are equally spaced about the periphery of the base portion.

32. The apparatus of claim 31 wherein three apertures are provided in the base portion.

* * * * *